US007033099B2

(12) United States Patent
Moutinho

(10) Patent No.: US 7,033,099 B2
(45) Date of Patent: Apr. 25, 2006

(54) ARRANGEMENT APPLIED IN PACKAGE

(76) Inventor: Antonio Sergio Moutinho, Alameda Franca, 37, Alphaville Barueri (BR)

( * ) Notice: Subject to any disclaimer, the term of this patent is extended or adjusted under 35 U.S.C. 154(b) by 0 days.

(21) Appl. No.: 10/891,209

(22) Filed: Jul. 14, 2004

(65) Prior Publication Data

US 2005/0013648 A1 Jan. 20, 2005

(30) Foreign Application Priority Data

Jul. 18, 2003 (BR) ..... 8301726 U

(51) Int. Cl.
*A46B 5/02* (2006.01)
*B43M 11/06* (2006.01)
*B43K 8/12* (2006.01)

(52) U.S. Cl. ..... 401/6; 401/183; 401/207; 16/430

(58) Field of Classification Search ..... 401/6, 401/183–186, 198, 196, 207; 222/207; 16/430; D9/338

See application file for complete search history.

(56) References Cited

U.S. PATENT DOCUMENTS 2,002,598 A * 5/1935 Wood Jr. ..... 401/207
3,581,953 A * 6/1971 Donoghue ..... 222/207
5,197,815 A * 3/1993 Sibley ..... 401/202
5,577,851 A * 11/1996 Koptis ..... 401/202
5,945,076 A * 8/1999 Leonard et al. ..... 422/300

* cited by examiner

*Primary Examiner*—David J. Walczak
(74) *Attorney, Agent, or Firm*—McKee, Voorhees & Sease, P.L.C.

(57) ABSTRACT

"ARRANGEMENT APPLIED IN PACKAGE", notably to hold a liquid, colored specific to recover the esthetics of threads, or mortar surfaces between ceramic pieces, or even internal and external areas of buildings in general, including facades; characterized by a plastic tube (1) ergonomically designed, being equipped with a threaded nozzle (2), preferably of rigid PVC, which receives highly-resistant wedge-shaped foam (7); the plastic tube (1) has a lower cylindrical part (3), an intermediate cone-shaped trunk region (4), a substantially cylindrical upper segment (5) followed by an inverted cone-shaped trunk terminal (6), to finally reach the threaded nozzle (2).

13 Claims, 3 Drawing Sheets

ARRANGEMENT APPLIED IN PACKAGE

This application for a utility model patent concerns a new "ARRANGEMENT APPLIED IN PACKAGE", which consists of a plastic tube whose lines provide a grip similar to that of a pen, with a tip made of highly resistant foam soaked by the liquid contained in the package. This allows its application to slender surfaces with a high degree of rugosity.

Its advantages are ease of application and appropriate ergonomics.

In the current STATE OF THE ART, this kind of package (squeeze tube type) has its function limited to the application of certain footwear paints and some hygiene and cleaning products.

The innovation is an ergonomically designed plastic tube whose lines form a grip that facilitates its handling. It has a screw-on tip, preferably of rigid PVC, which receives a highly resistant wedge-shaped foam. When the package is tipped in the direction of the foam, the latter is soaked by the liquid contained in the package. This allows the liquid in the foam to be applied in a controlled manner, with respect to quantity, on restricted and/or slender surfaces with a high degree of rugosity, such as on ceramic or stone cement threads.

Figure 1:
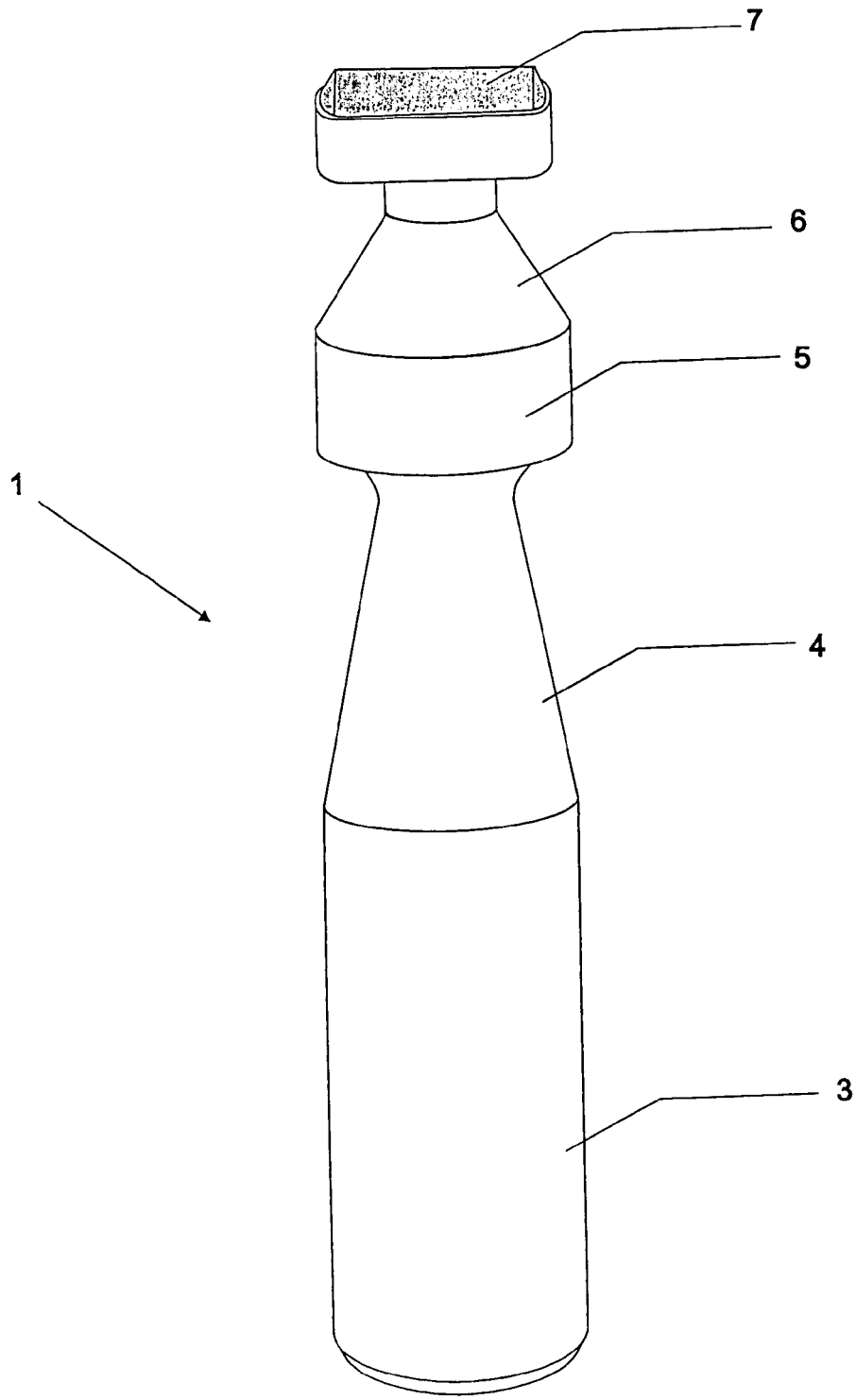
Figure 2:
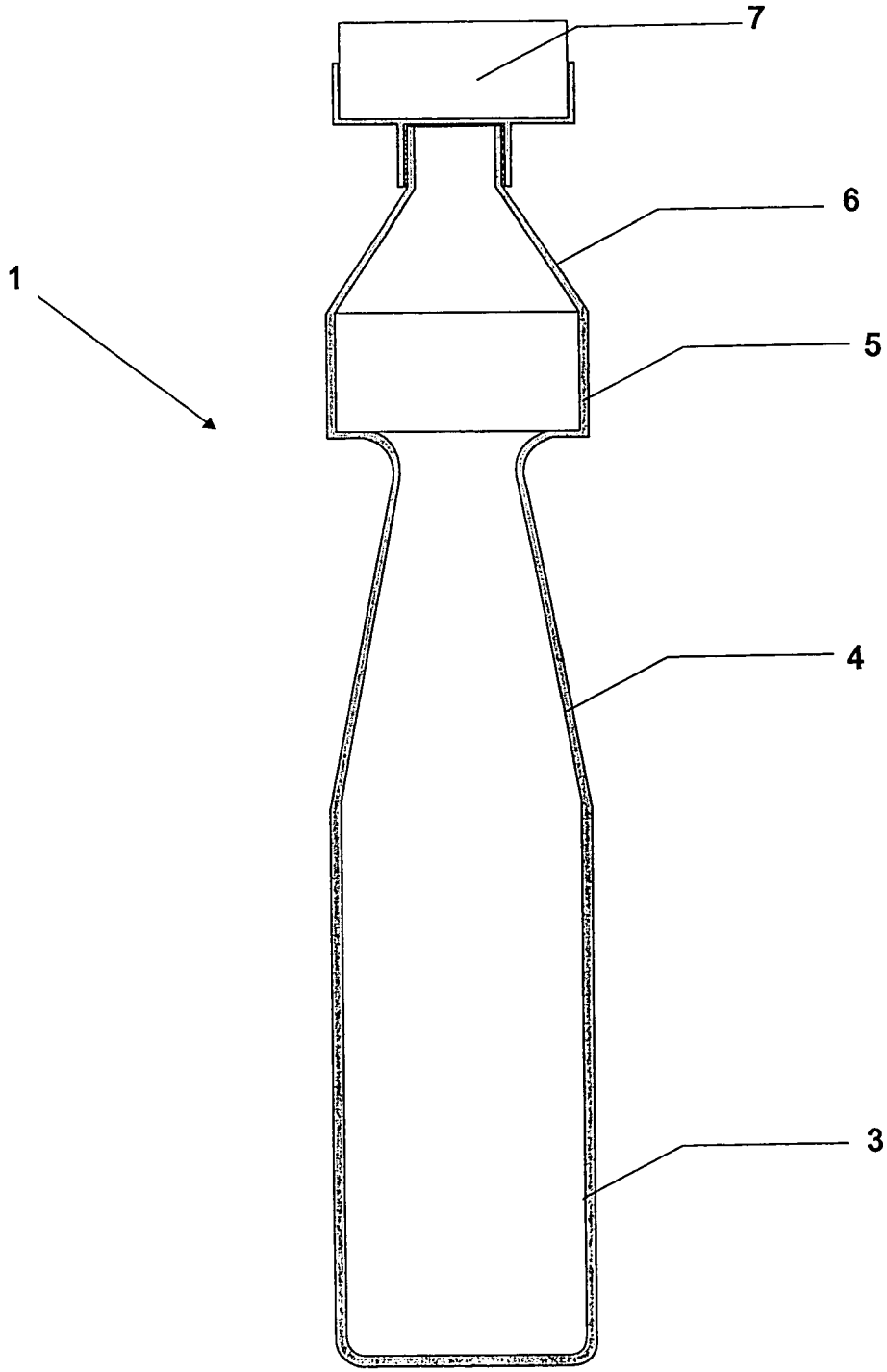
Figure 3:
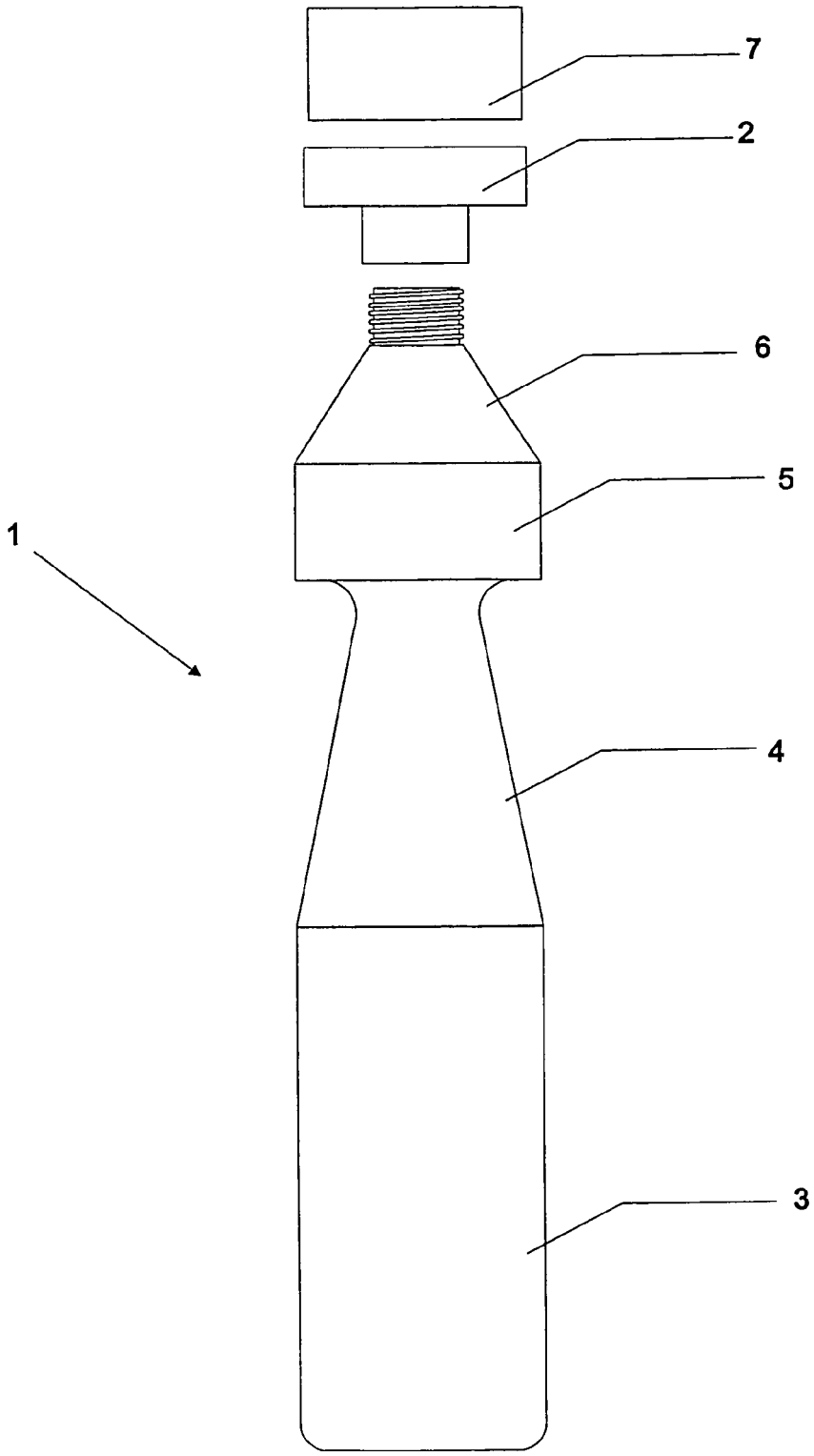

The model will be explained more clearly through the drawings listed below:

FIG. 1: Drawing in perspective of the arrangement applied in package;

FIG. 2: Cross section of the arrangement applied in package;

FIG. 3: Exploded view of the arrangement applied in package.

The "ARRANGEMENT APPLIED IN PACKAGE", which is the object of this application for a Utility Model Patent, consists of a package similar to a squeeze tube, formed by an ergonomically designed plastic tube (1) whose lines form a grip that facilitates its handling. It has a screw-on tip (2), preferably of rigid PVC, which receives a highly resistant wedge-shaped foam (7).

The plastic tube (1) has a cylindrical lower part (3), an intermediate cone-shaped trunk region (4) to allow greater flow velocity, and a substantially cylindrical upper section (5) followed by an inverted cone terminal (6), finally arriving at the screw-on tip (2).

The tip (2) receives a highly resistant wedge-shaped foam (7). When the package is tipped in the direction of the foam (7), the latter is soaked by the liquid contained in the package. This allows the liquid in the foam (7) to be applied in a controlled manner, with respect to quantity, on restricted and/or slender surfaces with a high degree of rugosity, such as on ceramic or stone cement threads.

The product contained in the package is a colored liquid, specifically for recovering the aesthetic appearance of threads, or grout surfaces between ceramic parts, or even in internal or external areas of buildings in general, including facades. The liquid contained in it consists of styrenated acrylic emulsion, inert minerals, inorganic pigments, aliphatic hydrocarbons, glycols and etoxylated and carboxylated tenso-active substances.

The application is made on the placement joints, between the parts, squeezing the tube and sliding the foam over the surface.

The invention claimed is:

1. A liquid applicator, comprising:

a plastic container for containing liquid and having:

a lower cylindrical portion;

an intermediate conical tapered portion that tapers upward and inward and has a first end that extends from an end of said lower cylindrical portion and a second opposite end;

an upper substantially cylindrical portion that has a first end that extends from said second end of said intermediate conical tapered portion and a second opposite end wherein a diameter of said upper substantially cylindrical portion is greater than a diameter of said second end of said intermediate conical portion; and an upper conical tapered portion that tapers upward and inward and has a first end extending from said second end of said upper substantially cylindrical portion and a second opposite end;

a tip connected to the upper tapered portion at said second end thereof;

a foam piece on the tip to apply liquid from the container onto a surface;

the container being free from internal obstructions such that when the container is inverted, any liquid in the lower cylindrical portion can flow from the lower cylindrical portion through the intermediate tapered portion, the upper substantially cylindrical portion and the upper tapered portion for discharge through the tip and foam piece onto the surface.

2. The liquid applicator of claim 1 wherein the cylindrical portions and the substantially cylindrical portion have substantially equal diameters.

3. The liquid applicator of claim 1 wherein the intermediate tapered portion has a height greater than the height of the upper substantially cylindrical portion.

4. The liquid applicator of claim 1 wherein the upper substantially cylindrical portion and upper tapered portion have substantially equal heights.

5. The liquid applicator of claim 1 wherein the intermediate tapered portion has upper and lower ends with the diameter of the upper end being approximately ½ the diameter of the lower end.

6. The liquid applicator of claim 1 wherein the intermediate tapered portion defines a gripping area for a user's fingers.

7. The liquid applicator of claim 1 wherein the container provides a pen-like grip for a user.

8. A liquid applicator, comprising:

a plastic container for storing a liquid, and having:

a lower cylindrical portion;

an intermediate conical tapered portion that tapers upward and inward and has a first end that extends from an end of said lower cylindrical portion and a second opposite end;

an upper substantially cylindrical portion that has a first end that extends from said second end of said intermediate conical tapered portion and a second opposite end wherein a diameter of said upper substantially cylindrical portion is greater than a diameter of said second end of said intermediate conical portion; and an upper conical tapered portion that tapers upward and inward and has a first end extending from said second end of said upper substantially cylindrical portion and a second opposite end;

a tip connected to the upper tapered portion at said second end thereof;

a foam piece an the tip to apply liquid from the container onto a surface;

the intermediate tapered portion defining a pen-like grip for the user;

whereby upon inversion of the container all the liquid is free to flow from the lower cylindrical portion to the upper tapered portion.

9. The liquid applicator of claim 8 wherein the cylindrical portion and the substantially cylindrical portion have substantially equal diameters.

10. The liquid applicator of claim 8 wherein the intermediate tapered portion has a height greater than the height of the upper substantially cylindrical portion.

11. The liquid applicator of claim 8 wherein the upper substantially cylindrical portion and upper tapered portion have substantially equal heights.

12. The liquid applicator of claim 8 wherein the intermediate tapered portion has upper and lower ends with the diameter of the upper end being approximately ½ the diameter of the lower end.

13. The liquid applicator of claim 8 wherein the container being free from internal obstructions such that liquid can flow from the lower cylindrical portion through the intermediate tapered portion, the upper substantially cylindrical portion and the upper tapered portion for discharge through the nozzle and foam piece onto the surface.

* * * * *